US009765683B2

(12) United States Patent
Lazich et al.

(10) Patent No.: US 9,765,683 B2
(45) Date of Patent: Sep. 19, 2017

(54) MODULAR WATER PUMP

(75) Inventors: Ivan M. Lazich, Skokie, IL (US); Bienvenido L. Yadao, Jr., Romeoville, IL (US)

(73) Assignee: International Engine Intellectual Property Company, LLC., Lisle, IL (US)

( * ) Notice: Subject to any disclaimer, the term of this patent is extended or adjusted under 35 U.S.C. 154(b) by 508 days.

(21) Appl. No.: 14/372,477

(22) PCT Filed: Jan. 18, 2012

(86) PCT No.: PCT/US2012/021665
§ 371 (c)(1),
(2), (4) Date: Jul. 16, 2014

(87) PCT Pub. No.: WO2013/109262
PCT Pub. Date: Jul. 25, 2013

(65) Prior Publication Data

US 2015/0010392 A1 Jan. 8, 2015

(51) Int. Cl.
*F01P 5/10* (2006.01)
*F01P 7/16* (2006.01)
(Continued)

(52) U.S. Cl.
CPC ..... *F01P 5/10* (2013.01); *F01P 5/12* (2013.01); *F01P 7/16* (2013.01); *F01P 7/161* (2013.01);
(Continued)

(58) Field of Classification Search
CPC ..... F01P 5/10; F01P 5/12; F01P 7/16; F01P 7/161; F01P 11/04; F04D 29/426; F04D 29/628; F04D 15/0263; F04D 15/00; F04D 15/0011; F04D 15/0022; F04D 15/0005; F04D 29/046; F04D 29/0462;
(Continued)

(56) References Cited

U.S. PATENT DOCUMENTS 2,206,488 A * 7/1940 Pavlecka ..... F04D 29/126 29/888.024
4,925,367 A 5/1990 Paliwoda
(Continued)

FOREIGN PATENT DOCUMENTS

GB 817021 A * 7/1959

OTHER PUBLICATIONS

International Preliminary Report on Patentability for PCT/US2012/021665, Jul. 22, 2014.*

*Primary Examiner* — Christopher Verdier
(74) *Attorney, Agent, or Firm* — Jeffrey P. Calfa; Jack D. Nimz

(57) ABSTRACT

A water pump apparatus is provided having a plurality of modular components, which allows for construction of various configurations of the water pump apparatus depending on specific vehicle requirements. The water pump apparatus modular components include a pump housing with a fluid chamber formed therein, a bearing housing for attachment to the pump housing, and a thermostat housing for connecting to the bearing housing and the pump housing. A method for forming modular components for assembling a water pump apparatus for use in an internal combustion engine is also provided.

14 Claims, 4 Drawing Sheets

(51) Int. Cl.

| | |
|---|---|
| ***F04D 15/02*** | (2006.01) |
| ***F01P 5/12*** | (2006.01) |
| ***F04D 29/42*** | (2006.01) |
| ***F04D 29/62*** | (2006.01) |
| *F01P 11/04* | (2006.01) |

(52) U.S. Cl.
CPC ..... *F04D 15/0263* (2013.01); *F04D 29/426* (2013.01); *F04D 29/628* (2013.01); *F01P 11/04* (2013.01); *F05B 2230/50* (2013.01); *F05B 2230/60* (2013.01); *F05D 2230/50* (2013.01); *F05D 2230/60* (2013.01); *Y10T 29/49236* (2015.01)

(58) Field of Classification Search
CPC ..... Y10T 29/49236; Y10T 29/49243; F05D 2230/50; F05D 2230/51; F05D 2230/60; F05B 2230/50; F05B 2230/60
USPC ..... 415/47, 126–128, 229–231; 123/41.44, 123/41.47, 198 C, 195 C
See application file for complete search history.

(56) References Cited

U.S. PATENT DOCUMENTS

| | | | | |
|---|---|---|---|---|
| 5,660,521 | A | 8/1997 | Serio | |
| 6,176,204 | B1 | 1/2001 | Heer | |
| 6,394,059 | B2 | 5/2002 | Guzman | |
| 6,752,590 | B2 | 6/2004 | Serio | |
| 2004/0178281 | A1* | 9/2004 | Moriyama | F01P 7/16 236/93 R |
| 2008/0149051 | A1* | 6/2008 | Pipkorn | F01P 5/10 123/41.44 |
| 2011/0116921 | A1* | 5/2011 | Lee | F04D 29/0473 415/229 |

* cited by examiner

MODULAR WATER PUMP

TECHNICAL FIELD OF THE INVENTION

The present invention relates to a water pump apparatus for an internal combustion engine. Particularly, the present invention provides a modular water pump apparatus with interchangeable modular components.

BACKGROUND OF THE INVENTION

Internal combustion engines include a massive engine block within which the engine cylinders are formed. Typically, the block is water cooled by means of forming passageways through the block and pumping coolant liquid through the passageways. Usually, the coolant is formed of a mixture of water and anti-freeze additive and the like.

In conventional engines, a water pump is mounted on brackets, which are in turn mounted either upon the engine or more usually, within the engine compartment of the vehicle. These water pumps generally comprise a rotating impeller mounted upon a shaft which also carries a drive wheel. The drive wheel is located outside of the pump housing for connection to a suitable belt, chain or gear drive, which is connected to a power source. The impeller is sealed within the pump housing. Inlet and outlet openings are formed in the pump housing and suitable hoses or tubing connect these openings to the engine block coolant passageways. Thus, coolant liquid or water flow into the pump housing and are forced outwardly of the pump housing by the rotating impeller blades to return to the engine block coolant passageways.

Although modern water pumps are relatively small in size, nevertheless such pumps require space within the engine compartment where space is at a premium. Further, in order to compensate for smaller spaces, and perhaps for simpler assembly or specific vehicle requirements, it may also be desirable to locate the thermostat housing nearer to the water pump. In addition, the manner in which the water pump components are typically constructed may not offer options or alternatives for attachment based on the specific vehicle space and operation requirements.

Thus, there is a need for a water pump apparatus comprised primarily of modular components, including those relating to a pump housing, a bearing housing and a thermostat housing, having simple and cost-effective construction. There is also a need for a modular water pump apparatus that can be cast from primarily three main die casts, wherein the modular components will provide different water pump configurations and options for assembly, using the same castings, and based on the desired coolant flow direction and/or engineering requirements of the specific vehicle.

SUMMARY OF THE INVENTION

There is disclosed herein an improved water pump apparatus and method having modular components, which avoids disadvantages of prior devices, while affording additional structural and operating advantages.

Generally speaking, a water pump apparatus is disclosed having a plurality of modular components, which allows for construction of various configurations depending on specific vehicle requirements. The water pump apparatus modular components include a pump housing with a fluid chamber formed therein, a bearing housing for attachment to the pump housing, and a thermostat housing for connecting to the bearing housing and the pump housing.

In an embodiment of the invention, the pump housing includes a front portion and a back portion forming a fluid chamber therein. The bearing housing includes a water inlet. There is a rotational shaft rotatably supported within the bearing housing by a set of bearings, and an impeller fixed to the shaft, wherein the impeller is located within the fluid chamber of the pump housing. A thermostat housing connects with the bearing housing and the pump housing, the thermostat housing being integrally connected to a water inlet passage and a water outlet passage. The bearing housing is interchangeably connected to one of either a right side or a left side of the pump housing.

In another embodiment of the invention, the water inlet passage of the thermostat housing sealingly connects to the water inlet of the bearing housing, such that the bearing housing and the thermostat housing are interchangeably connected to one of either a right side or a left side of the pump housing.

In yet another embodiment of the invention, the bearing housing is rotatable about a 180° axis before attachment to the pump housing and subsequently to the thermostat housing.

In yet another embodiment of the invention, a method for forming modular components for assembling a water pump apparatus for use in an internal combustion engine, is disclosed. The method comprises the steps of forming a modular component casting mold, forming the modular component through introduction of molten material into the casting mold, cooling the molten material for a specific time, removing the cast modular component from the mold, and assembling the modular components into the water pump apparatus having one of a right hand assembly or a left hand assembly, the modular components comprising a pump housing, a bearing housing and a thermostat housing.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE INVENTION

Figure 1:
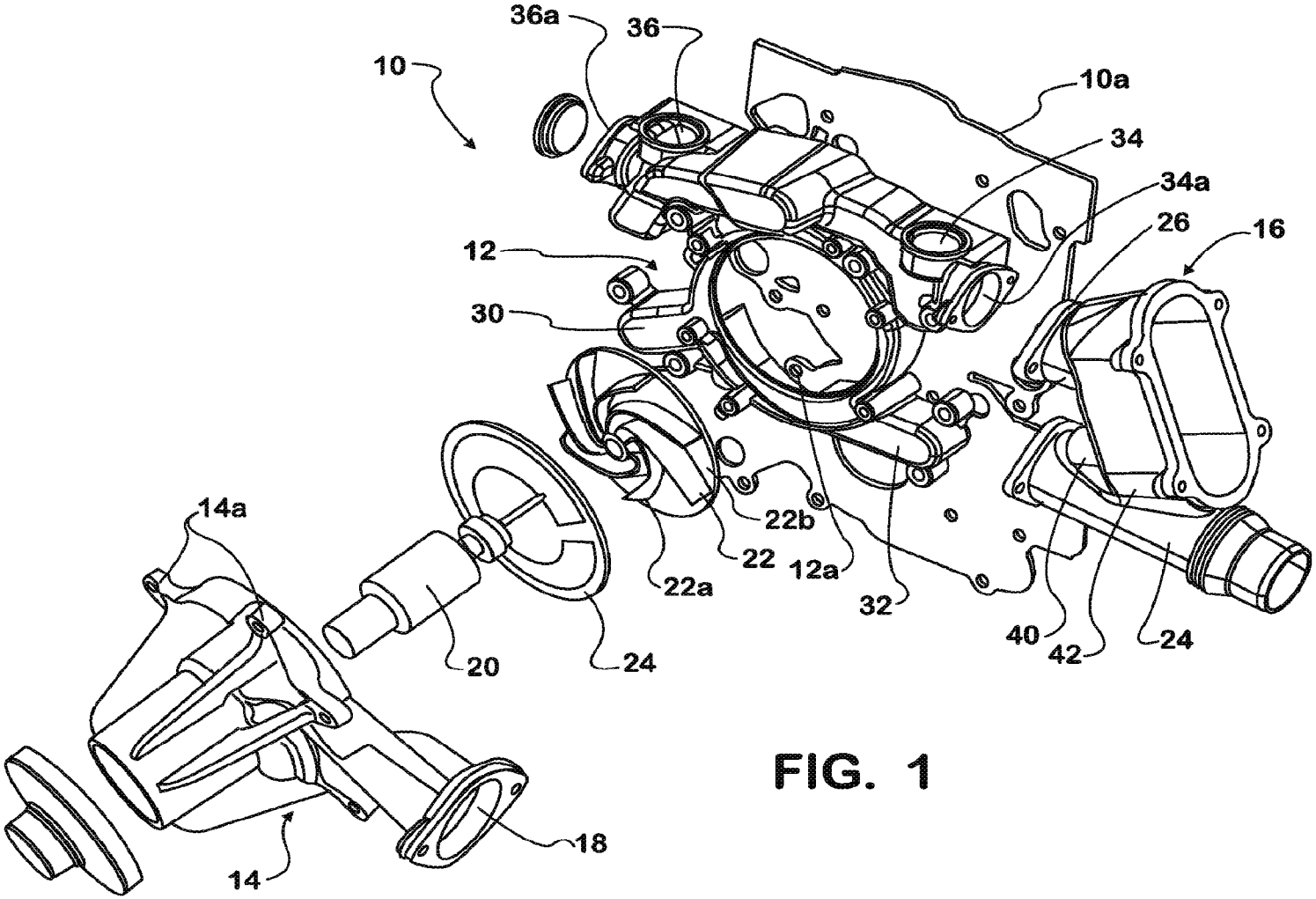
FIG. 1 is an exploded view of an embodiment of the present invention.
Figure 3:
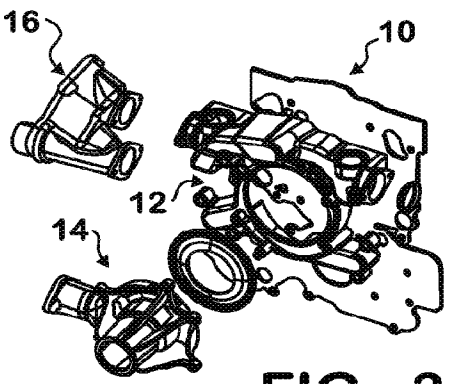
FIG. 3 is a disassembled view of a right hand configuration of the present invention.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to embodiments illustrated.

Referring to FIG. 1, there is illustrated an exploded view of a modular water pump apparatus 10 of the present invention. Generally speaking, the water pump apparatus 10 is comprised of three main modular components, including a pump housing 12, a bearing housing 14 and a thermostat housing 16. The modular components, and in particular, the pump housing 12 and the bearing housing 14, can be constructed of any suitable materials, including a die cast aluminum. The thermostat housing 16 may be constructed from any know materials, including an injection molded plastic. The general operation of a water pump apparatus is well-understood by those skilled in the art and, for the sake of clarity and conciseness, will not be described in greater detail herein.

Referring to FIGS. 1-4, there are illustrated embodiments of the modular water pump apparatus 10 or portions thereof. The pump housing 12 includes a fluid chamber 12*a* formed therein. Associated with the pump housing 12 are two lower coolant passages 30 and 32 for passage of coolant from the fluid chamber to the engine (not shown), and two upper coolant passages 34 and 36 for receipt of heated coolant from the engine. Projecting from either side of the pump housing is a flanged opening 34*a* and 36*a*, which connects to one of the upper coolant passages, respectively. Depending on the configuration of the water pump apparatus, and the desired direction of coolant flow, a plug 46 may be positioned within either of the flanged openings 34*a* or 36*a*. The pump housing 12 is attached to the front of a crankcase cover 10*a* in a well-known manner.

A second modular component of the present invention is a bearing housing 14. The bearing housing 14 includes a water inlet 18, which permits flow of the coolant into the fluid chamber 12*a* of the pump housing 12. In addition, the bearing housing 14 receives a rotatable shaft 20, which is supported within the bearing housing by a plurality of bearings (not shown). For connecting the bearing housing 14 to the pump housing 12, the bearing housing includes a plurality of mounting receptacles 14*a*, which receive an appropriate fastener for mounting to an mounting receptacle 12*b* on the pump housing. The bearing housing 14 and the water inlet 18 are rotatable about a 180° axis between a left hand configuration (FIG. 2) and a right hand configuration (FIG. 3), based on the position of the water inlet 18, prior to attachment to the pump housing 12, and subsequent attachment to the thermostat housing 16. The mounting receptacles 14*a* on the bearing housing 14 are symmetrically placed to permit the bearing housing to be attached to the pump housing in either the right hand or left had configuration. Rotation of the bearing housing 14 provides options for changing the configuration of the water pump apparatus, as well as, the direction of coolant flow through the water pump apparatus.

As further shown in FIG. 1, the water pump apparatus 10 includes a fan-shaped impeller 22. The impeller 22 is mounted to the rotatable shaft 20, positioned opposite the bearing housing 14, and is received within the fluid chamber 12*a* of the pump housing 12. The impeller 22 is constructed of known materials, and includes a plurality of vanes 22*a* positioned on a flange 22*b*, which forms a seal within the fluid chamber 12*a* of the pump housing 12. In operation, when coolant enters the fluid chamber 12*a*, the coolant is thrown by centrifugal force by the impeller vanes 22*a* to the two lower coolant passages 30 and 32 for re-entry into the engine (not shown).

Figure 2:
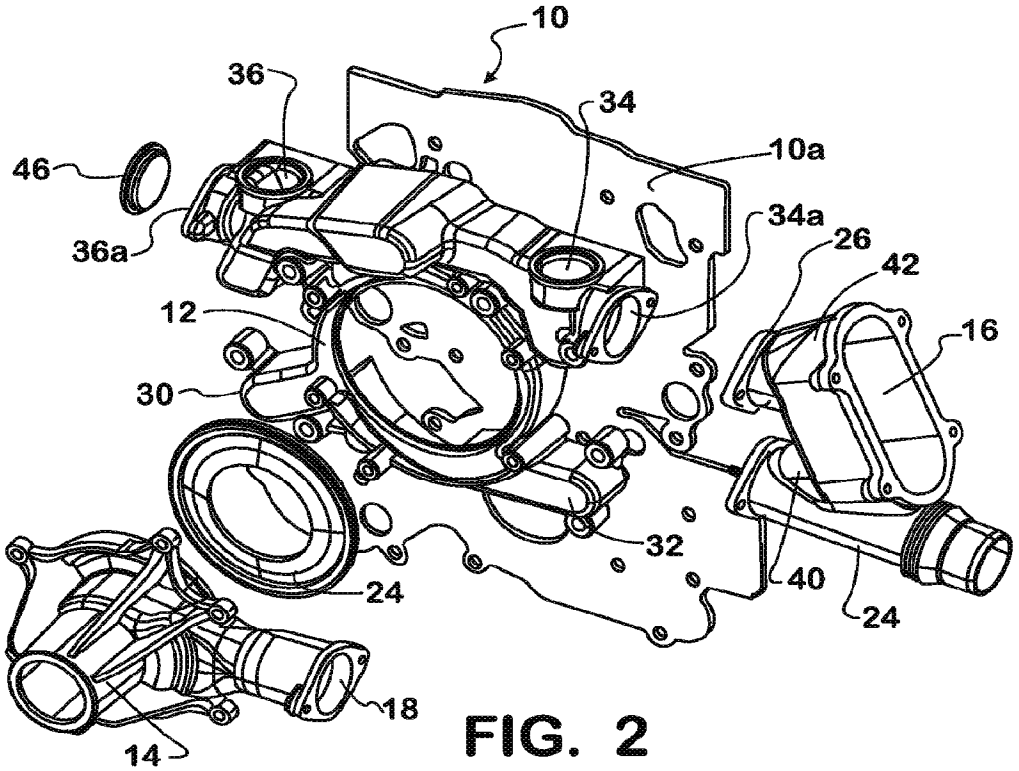
FIG. 2 is a disassembled view of a left hand configuration of the present invention.

In connection with the impeller 22, an impeller shroud and gasket 24 are shown in FIGS. 1 and 2. The impeller shroud and gasket 22 is positioned between the bearing housing 14 and the front of the pump housing 12, when the bearing housing is attached to the pump housing. The impeller shroud and gasket 22 forms a water impermeable seal between the pump housing 12 and the bearing housing 14, sealing the impeller 22 within the fluid chamber 12*a* of the pump housing, and can be constructed from known materials, including from an injection molded plastic.

Figure 4:
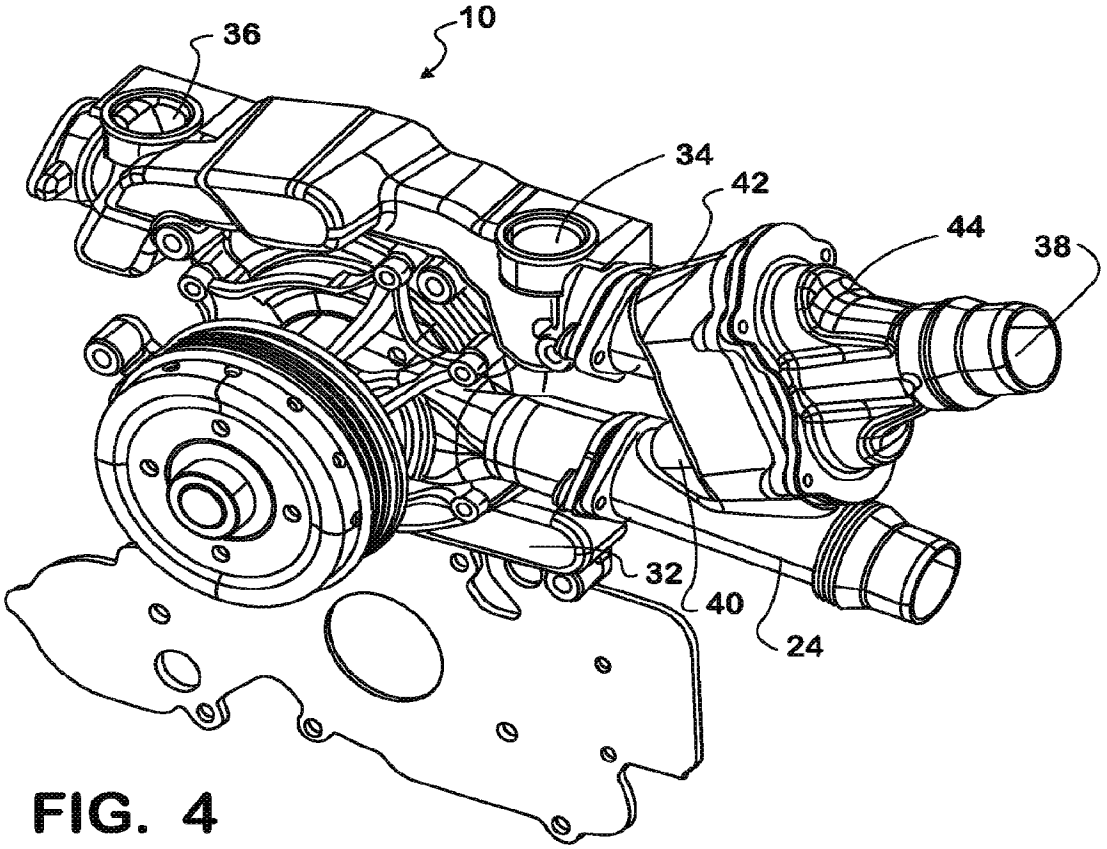
FIG. 4 is a constructed assembly of the present invention.

As shown in FIGS. 2 and 4, the water pump apparatus includes a thermostat housing 16. The thermostat housing 16 is a modular unit having a base 42 for containing the thermostat (not shown) and a cover 44, which includes a coolant return passage 38. The cover 44, which is removable for access to the thermostat, may be attached to the base 42 in a known manner. The thermostat housing 16 also includes a water outlet passage 26, for connecting to one of the respective flanged openings 34*a* or 36*a* of the pump housing 12 and for receiving coolant returning from the engine, a water inlet passage 24, and a by-pass passage 40, wherein all of the passages are formed as integral pieces with the base 42 of the housing. When the thermostat housing 16 is connected to the bearing housing 14, and more specifically, when the water inlet passage 24 of the thermostat housing is connected to the water inlet 18 of the bearing housing, coolant enters the pump housing 12 and its fluid chamber 12*a* through the water inlet passage 24 and water inlet when it returns from the radiator. Coolant may also enter the fluid chamber 12*a* through the by-pass passage 40 of the thermostat housing 16.

Figure 5:
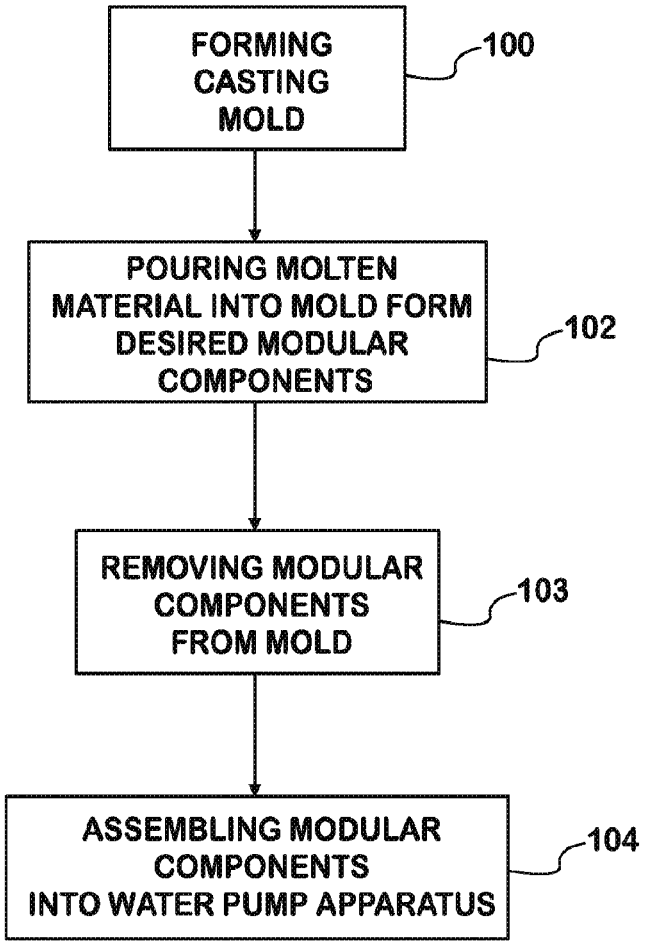
FIG. 5 is a schematic drawing of the method of the present invention.

FIG. 5 shows a method for forming the modular water pump apparatus 10 of the present invention. In a first step 100, casting molds (not shown) are formed to be used in the casting the desired modular components, namely, the pump housing 12, bearing housing 14 and thermostat housing 16. Those skilled in the art will recognize that the final configuration of the modular water pump apparatus will depend on the requirements of the particular vehicle it will be used in. The casting molds are formed using typical and well-known die casting techniques.

In a second step 102, the modular components are formed by pouring molten material, preferably aluminum, which exhibits good weight and strength characteristics, into the casting molds. One skilled in the art will recognize that other materials may be suitable, such as grade cast iron, steel or gray steel, depending on specific engine applications. Similarly, the thermostat housing 16 and the impeller shroud 24 may be constructed from an appropriate injection molded plastic.

In a third step 103, after an appropriate cooling time, the modular components are removed from their respective casting molds, and finished appropriately. In a final step 104, the resulting modular components are connected to one another using known attachment means such as fastening bolts and coordinating mounting receptacles, to create the appropriate water pump apparatus configuration for the particular vehicle construction and application. By rotating the bearing housing 14 by 180° prior to attachment to the pump housing 12, the resulting water pump apparatus can have either a left hand configuration (FIG. 2) or a right hand configuration (FIG. 3) assembly. Options in the configuration of the water pump offer advantages relating to cost-savings in manufacturing time and complexity, and installation of these components.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A modular water pump apparatus comprising:

a pump housing having a front portion and a back portion, and a fluid chamber formed within the pump housing;

a bearing housing for attachment to the front portion of the pump housing, the bearing housing having a water inlet;

wherein the bearing housing is interchangeably connected to one of either a right side or a left side of the pump housing a rotational shaft rotatably supported within the bearing housing by a set of bearings;

an impeller fixed to the shaft, the impeller located within the fluid chamber of the pump housing;

a thermostat housing for connecting to the bearing housing and the pump housing;

wherein the thermostat housing is integrally connected with a water inlet passage and a water outlet passage; and wherein the water inlet passage sealingly engages with the water inlet of the bearing housing.

2. The modular water pump apparatus of claim 1, wherein the apparatus further includes an impeller shroud having a gasket.

3. The modular water pump apparatus of claim 2, wherein the impeller shroud and gasket are positioned between the bearing housing and the front portion of the pump housing.

4. The modular water pump apparatus of claim 1, wherein the back portion of the pump housing is connected to a front cover of a crankcase.

5. The modular water pump apparatus of claim 1, wherein the bearing housing is rotatable about a 180° axis before attachment to the pump housing.

6. The modular water pump apparatus of claim 1, wherein the thermostat housing is interchangeably connected to one of either the right side or the left side of the pump housing.

7. The modular water pump apparatus of claim 1, wherein the bearing housing and the thermostat housing are interchangeably connected to one of either the right side or the left side of the pump housing.

8. A water pump apparatus having a plurality of modular components, the water pump apparatus comprising:

a pump housing having a front portion and a back portion, and a fluid chamber formed within the pump housing;

a bearing housing for attachment to the front portion of the pump housing, the bearing housing having a water inlet;

a rotational shaft rotatably supported within the bearing housing by a set of bearings;

an impeller fixed to the shaft, the impeller located within the fluid chamber of the pump housing;

a thermostat housing for connecting with the bearing housing and the pump housing;

wherein the bearing housing and the thermostat housing are interchangeably connected to each other and to one of either a right side or a left side of the pump housing.

9. The water pump apparatus of claim 8, wherein the apparatus further includes an impeller shroud having a gasket.

10. The water pump apparatus of claim 9, wherein the impeller shroud and gasket are positioned between the bearing housing and the front portion of the pump housing.

11. The water pump apparatus of claim 10, wherein the thermostat housing is integrally connected with a water inlet passage and a water outlet passage.

12. The water pump apparatus of claim 11, wherein the water inlet is sealingly engaged to the water inlet of the bearing housing.

13. The water pump apparatus of claim 8, wherein the bearing housing is rotatable about a 180° axis before attachment to the thermostat housing and the pump housing.

14. The water pump apparatus of claim 13, wherein the rotatable bearing housing results in one of either a left hand water inlet assembly or a right hand water inlet assembly.

* * * * *